US011812904B2

(12) United States Patent
Babikian

(10) Patent No.: US 11,812,904 B2
(45) Date of Patent: Nov. 14, 2023

(54) CONDUIT FOR FILLING A FLUID RESERVOIR AND METHODS FOR FILLING A FLUID RESERVOIR

(71) Applicant: BOBRICK WASHROOM EQUIPMENT, INC., North Hollywood, CA (US)

(72) Inventor: Dikran Babikian, Glendale, CA (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 40 days.

(21) Appl. No.: 17/496,668

(22) Filed: Oct. 7, 2021

(65) Prior Publication Data

US 2022/0022702 A1 Jan. 27, 2022

Related U.S. Application Data

(62) Division of application No. 16/989,610, filed on Aug. 10, 2020, now Pat. No. 11,432,686, which is a (Continued)

(51) Int. Cl.

| | |
|---|---|
| ***A47K 5/12*** | (2006.01) |
| ***A47K 5/14*** | (2006.01) |
| ***B05B 11/00*** | (2023.01) |
| ***B05B 12/08*** | (2006.01) |
| ***G08B 5/38*** | (2006.01) |

(Continued)

(52) U.S. Cl.

CPC ..... *A47K 5/1217* (2013.01); *A47K 5/1205* (2013.01); *A47K 5/1211* (2013.01); *A47K 5/14* (2013.01); *B05B 11/0097* (2013.01); *B05B 12/081* (2013.01); *B05B 15/30* (2018.02); *G08B 5/38* (2013.01); *A47K 2005/1218* (2013.01); *B05B 11/0089* (2013.01); *B05B 11/1001* (2023.01)

(58) Field of Classification Search

CPC .. A47K 5/1217; A47K 5/1205; A47K 5/1211; A47K 5/14; A45K 2005/1218; B05B 15/30; B05B 12/081; B05B 11/0097; B05B 11/1001; B05B 11/0089; B05B 11/0051; B05B 11/3001; B05B 11/3061; G08B 5/38

USPC ..... 222/1, 180, 325, 173, 190, 324, 185.1, 222/186

See application file for complete search history.

(56) References Cited

U.S. PATENT DOCUMENTS 1,355,952 A 10/1920 Even
1,362,077 A * 12/1920 Bobrick ..... A47K 5/1205 222/321.3

(Continued)

FOREIGN PATENT DOCUMENTS

| | | | |
|---|---|---|---|
| DE | 3521580 A1 | * | 6/1985 |
| EP | 499538 A1 | * | 2/1992 |
| JP | 8-156983 | * | 8/1996 |

OTHER PUBLICATIONS

Exam report issued in related Australian Application No. 2021203076, dated Jun. 8, 2022, 3 pages.

*Primary Examiner* — Lien M Ngo
(74) *Attorney, Agent, or Firm* — LEWIS ROCA ROTHGERBER CHRISTIE LLP

(57) ABSTRACT

A method of filling a fluid dispenser is provided and a method for operating power driven pump in a dispenser is provided.

20 Claims, 6 Drawing Sheets

Related U.S. Application Data division of application No. 15/299,407, filed on Oct. 20, 2016, now Pat. No. 10,806,304.

(60) Provisional application No. 62/378,163, filed on Aug. 22, 2016, provisional application No. 62/244,687, filed on Oct. 21, 2015.

(51) Int. Cl.
*B05B 15/30* (2018.01)
*B05B 11/10* (2023.01)

(56) References Cited

U.S. PATENT DOCUMENTS

| | | | | |
|---|---|---|---|---|
| 2,772,116 | A | 11/1956 | Dobkin | |
| 3,402,857 | A | 9/1968 | Ecklund et al. | |
| 4,670,010 | A | 6/1987 | Dragone | |
| 5,397,028 | A | 3/1995 | Jesadanont | |
| 5,603,363 | A | 2/1997 | Nelson | |
| 5,850,947 | A * | 12/1998 | Kim | B05B 15/30 222/464.5 |
| 7,040,359 | B2 | 5/2006 | Younkle | |
| 7,753,087 | B2 | 7/2010 | Rhodenbaugh et al. | |
| 8,100,299 | B2 * | 1/2012 | Phelps | A47K 5/12 222/325 |
| 9,545,644 | B2 | 1/2017 | Ramdhiansing et al. | |
| 9,681,779 | B2 * | 6/2017 | Babikian | A47K 5/1211 |
| 2010/0213208 | A1 | 8/2010 | Bem | |
| 2015/0034680 | A1 | 2/2015 | Babikian | |
| 2015/0076176 | A1 | 3/2015 | Ray | |
| 2015/0223646 | A1 | 8/2015 | Wegelin et al. | |
| 2017/0027390 | A1 | 2/2017 | Maercovich | |

* cited by examiner

CONDUIT FOR FILLING A FLUID RESERVOIR AND METHODS FOR FILLING A FLUID RESERVOIR

CROSS REFERENCE TO RELATED APPLICATIONS

This application is a divisional of U.S. patent application Ser. No. 16/989,610, filed Aug. 10, 2020, which is a divisional of U.S. patent application Ser. No. 15/299,407, filed Oct. 20, 2016, now U.S. Pat. No. 10,806,304 issued Oct. 20, 2020, which claims the benefit of U.S. Provisional Patent Application Nos. 62/244,687, filed Oct. 21, 2015 and 62/378,163, filed Aug. 22, 2016 the contents of all of which are hereby incorporated by reference in their entirety

BACKGROUND

Fluid dispensers which are mounted to a countertop, and which can be filled from the top are often used in many bathrooms, especially commercial bathrooms. Such fluid dispensers include a dispensing outlet formed on a spout above the countertop and a reservoir mounted below the countertop. In order to fill the reservoir, a dispensing portion or a top portion of the dispenser is opened and fluid is poured through a conduit, such as a shank into the reservoir. The fluid is typically liquid soap or liquid soap designed to turn into foam. The problem when filling such dispensers is that as the liquid drops into the reservoir from the shank, it splutters and foams up filling the reservoir with foam, preventing the reservoir from filling a sufficient amount of liquid soap. This is especially pronounced when the liquid soap is liquid soap for being converted to foam during pumping and dispensing. Thus, a top filled fluid dispenser that may minimize the amount of foaming is desired.

SUMMARY

In an example embodiment a dispenser is provided including a reservoir, a shank extending from the reservoir, a funnel within the reservoir having a funnel portion and a conduit, the conduit extending within the reservoir and along a major length of the reservoir. A dispensing spout extends above the funnel. The reservoir if filled from the funnel. In another example embodiment, the conduit extends within about ⅛ to about 2 inches from a base of the reservoir. In yet another example embodiment, the conduit extends within about 1/16 to about 3 inches from a base of the reservoir. In a further example embodiment, the conduit extends to the base of the reservoir and includes opening proximate the base. In yet a further example embodiment, the funnel conduit includes a radially extending projection for providing a stop when the funnel is lifted. In one example embodiment, the projection is integrally formed with the funnel conduit. In another example embodiment, the projection is a grommet coupled to the funnel conduit. In a further example embodiment, the shank penetrates a counter top, the dispensing spout is above the countertop and the reservoir is below the counter top. In yet a further example embodiment, the dispenser also includes a vent opening formed through the funnel conduit for venting air or other gases from the reservoir. In another example embodiment, the vent opening is formed at a location at or proximate an upper end of the reservoir.

In yet another example embodiment a dispenser is provided including a reservoir, a shank extending from the reservoir, where the shank defines a funnel portion and a conduit. The conduit extends within the reservoir and along a major length of the reservoir. A dispensing spout extends above the funnel. The reservoir if filled from the funnel. In a further example embodiment, the conduit extends within about ⅛ to about 2 inches from a base of the reservoir. In yet a further example embodiment, the conduit extends within about 1/16 to about 3 inches from a base of the reservoir. In one example embodiment, the conduit extends to the base of the reservoir and includes opening proximate the base. In another example embodiment, the funnel conduit includes a radially extending projection for providing a stop when the funnel is lifted. In yet another example embodiment, the projection is integrally formed with the funnel conduit. In one example embodiment, the projection is a grommet coupled to the funnel conduit. In another example embodiment, the shank penetrates a counter top, the dispensing spout is above the countertop and the reservoir is below the counter top. In yet a further example embodiment, the dispenser also includes a vent opening formed through the funnel conduit for venting air or other gases from the reservoir. In one example embodiment, the vent opening is formed at a location at or proximate an upper end of the reservoir. In another example embodiment, the shank includes a first portion and a second portion with one of the first and second portions extending within the other of the first and second portions. In yet another example embodiment, the shank second portion is formed integrally with a cap of the reservoir.

In a further example embodiment, a method of filling a fluid dispenser is provided and includes removing a top portion of the dispenser exposing a pathway to the reservoir, filling the fluid dispenser with a fluid and guiding the fluid along a conduit extending along a major portion of the length of the reservoir. In yet a further example embodiment, guiding the fluid includes guiding the fluid within the conduit and exiting the fluid from the conduit within a distance of 3 inches from a base of the reservoir. In one example embodiment, guiding the fluid includes guiding the fluid within the conduit and exiting the fluid from the conduit within a distance of 3 inches from a base of the reservoir. In another example embodiment, the method further includes venting air displaced by filling the fluid through the conduit. In yet another example embodiment, venting the air includes venting the air through the conduit at a location at or proximate an upper end of the reservoir. In a further example embodiment, when the fluid dispenser has been filled sufficiently with the fluid, the conduit rises relative to the reservoir.

In yet a further example embodiment, a method for operating power driven pump in a dispenser is provided including sensing a level of a the liquid in a reservoir of the dispenser, activating an indicator when the level is at or below a predetermined level, and allowing only a predetermined number of dispenses from the dispenser after the activating. In one example embodiment, the pump is submerged in the liquid and wherein after the predetermined number of dispenses the pump remains submerged in the liquid. In another example embodiment, the method also includes activating another indicator after the predetermined number of dispenses have occurred. In yet another example embodiment, activating an indicator includes illuminating a light having a first color. In a further example embodiment, activating another indicator includes illuminating a light having a second color different from the first color. In yet a further example embodiment, the indicator and the another indicator are the same device that provides for the light having the first and the second color. In one example embodiment, the indicator and the another indicator are flashing indicators.

DETAILED DESCRIPTION OF THE INVENTION

Figure 1:
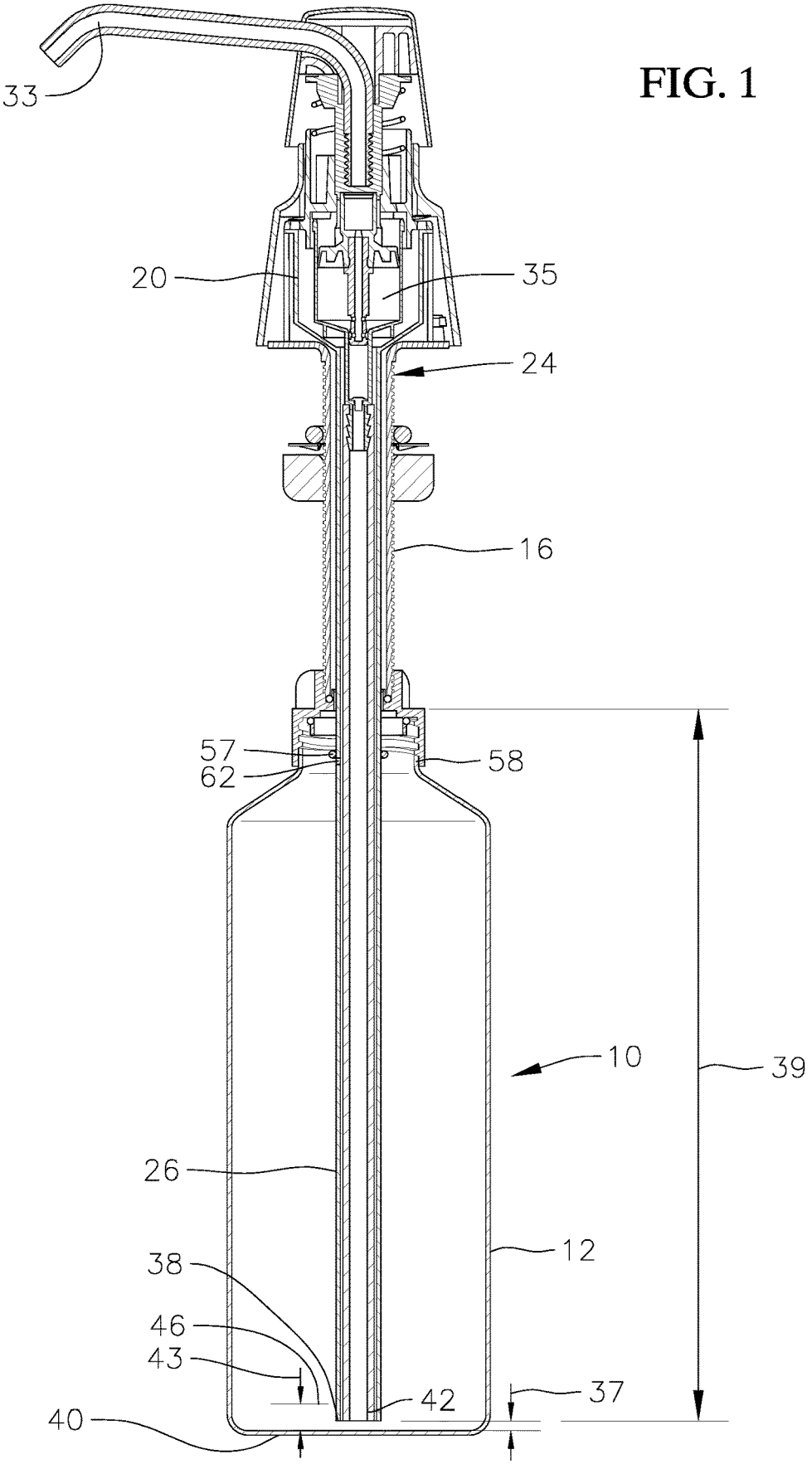
FIG. 1 is a cross-sectional view of an example embodiment manually operated dispenser.
Figure 2:
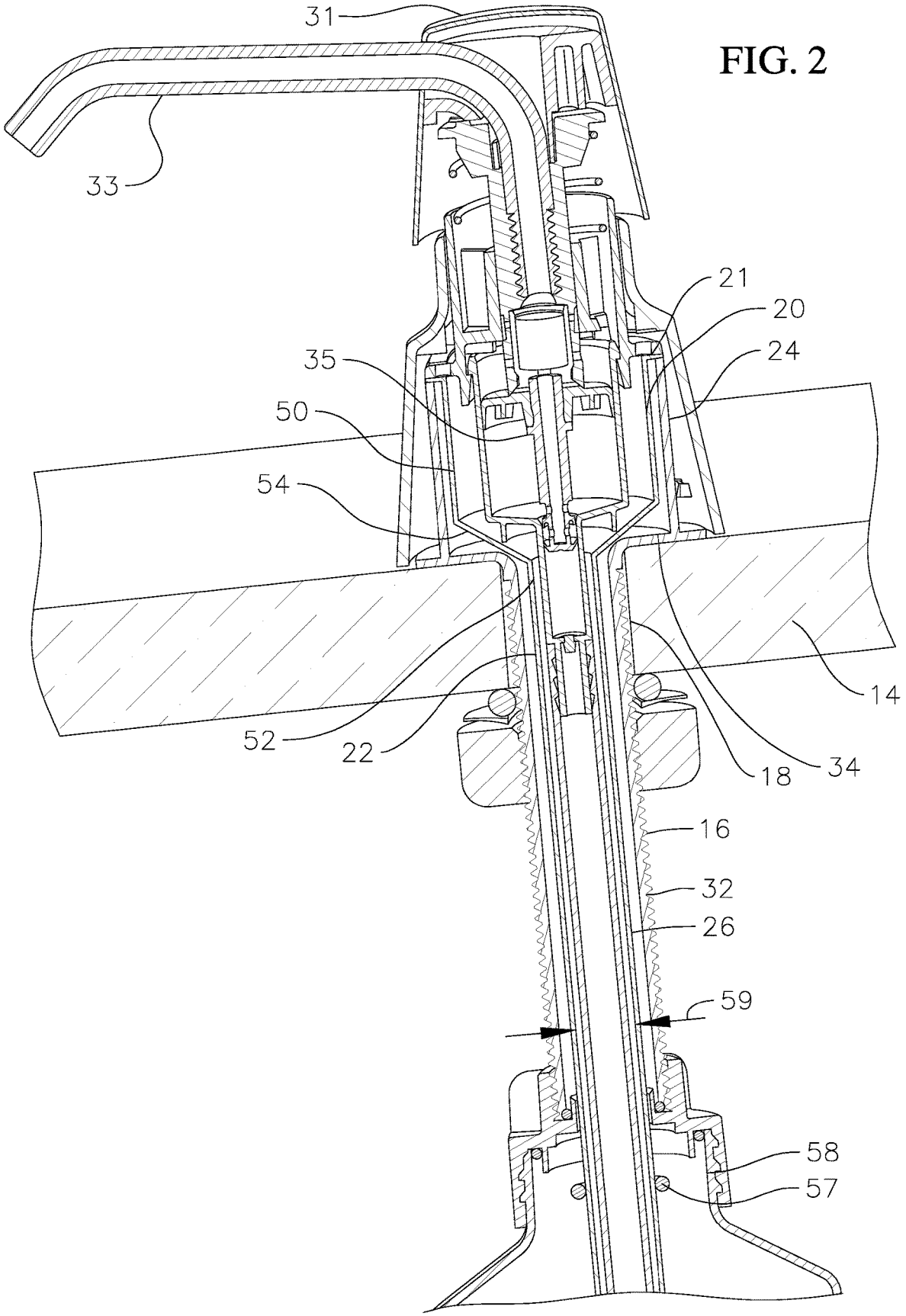
FIG. 2 is a partial cross-sectional view of the example embodiment dispenser shown in FIG. 1.
Figure 3:
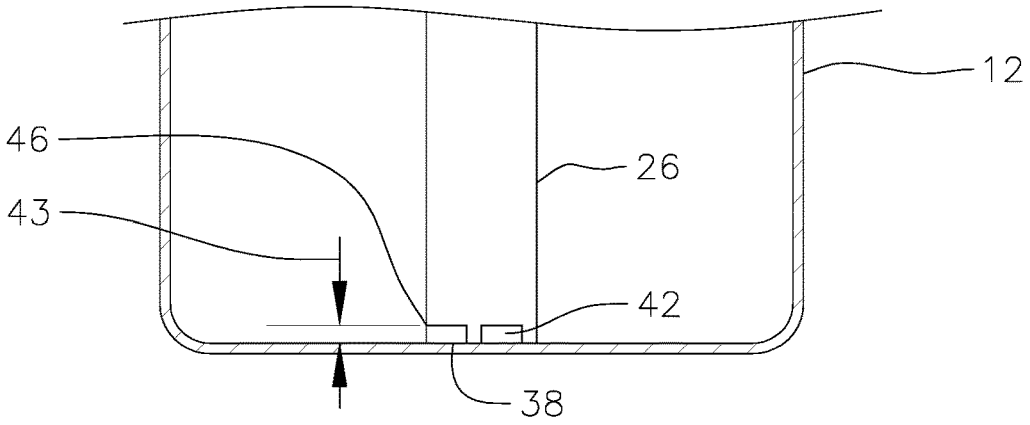
FIG. 3 is a partial cross-sectional view of a base portion of an example embodiment dispenser.

In an example embodiment, a fluid dispenser, such as a liquid fluid dispenser, a liquid soap or a liquid foam dispenser 10 is provided, as for example shown in FIGS. 1 and 2. The example embodiment dispenser shown in FIGS. 1 and 2 is a manual dispenser in that liquid soap or liquid foam, typically converted from liquid soap, is dispensed by pressing on a skirt 31 of a dispensing spout 33 for activating a pump 35. However, the disclosure is not limited only to manually operated dispensers as it can be used with power operated dispensers, such as automated dispensers, as for example shown in FIGS. 5 and 6. In an example embodiment, the dispenser includes a reservoir 12, such as a reservoir which is mounted below a countertop 14 (see FIG. 2). A shank 16, as for example a conduit or a cylindrical shank is mounted through an appropriate size opening 18 in the countertop 14. The reservoir 12 is coupled with the shank 16 below the countertop 14. This can be accomplished in an example embodiment with a cap 69 that is threaded to a threated outer surface 71 of the shank and to an outer surface of a neck 58 of the reservoir. A funnel portion 20 of a funnel 22 is positioned within an upper portion 24 of the shank. In an example embodiment, the upper portion 30 of the shank is enlarged to accept the funnel portion. The funnel 22 includes a funnel conduit 26 extending from a lower end of the funnel portion 20, and extending into the reservoir. In another example embodiment, the shank itself forms the funnel portion (i.e., the upper enlarged portion 30 of the shank forms a funnel portion) and includes a conduit portion 32 that extends into the reservoir. With this example embodiment, a separate funnel may not be required.

The dispensing spout 33 extends above the funnel and above the countertop. A dispensing spout is coupled to the pump 35 within the funnel portion 20 such that pressing the dispensing spout skirt 31 from the top activates the pump for pumping the liquid, such as liquid soap, or liquid soap which is converted to foam, and dispensing the same through the dispensing spout. In other example embodiments, the dispensing spout may be coupled to a pump within the reservoir which may be operated by a separate motor, as for example shown in FIG. 5.

In an embodiment where the funnel is fitted within the shank, a shank upper portion 30 has a larger diameter than the shank conduit portion 32, which penetrates the countertop. Thus, a shoulder 34 is formed between the larger and the smaller diameter portions of the shank. With this embodiment, when the funnel is in within the shank, a lip 21 extending radially from an upper end of the funnel rests against an upper edge 23 of the shank, suspending the funnel from the shank upper edge. The funnel has a sufficient length such that when it is suspended from the upper edge of the shank, a lower end 38 of the funnel conduit is spaced apart by a distance 37 of about ⅛ to about 2 inches from a base 40 of the reservoir. Similarly, in example embodiments where the shank extends proximate the bottom of the reservoir and a funnel is not used, a lower end of the shank conduit portion 32 extends to a location within about ⅛ to about 2 inches from the bottom of the reservoir. In other example embodiments the distance to the lower end of the funnel conduit (or shank conduit) from the base of the reservoir is less than ⅛ of an inch, as for example 1/16 inch. In other example embodiments, the distance may be 3 inches or less. In an example embodiment, the distance may be about 1/16 to about 3 inches. In other example embodiments, the reservoir has a length 39 as measured between a top end 41 and the base 40 of the reservoir. In example embodiment the funnel conduit 26 of the funnel extends from the top end 41 into the reservoir and extends along a majority of the length 39 within the reservoir.

In an example embodiment, the funnel or the shank may be sized such it extends to the base 40 of the reservoir, and at least an opening 42 is formed circumferentially at the bottom end 46 of the funnel conduit through the funnel conduit wall, or shank conduit through the shank conduit wall, allowing for fluid to exit through such opening. The opening may be formed at a location extending from the bottom end of the funnel or shank conduit to a distance 43 of about 1/16 to about 3 inches, and in an example embodiment, to a distance about ¼ to about ⅝ inches. In other example embodiments, the opening may be centered at a distance in the range of about 1/16 to about 3 inches, and in an example embodiment, to a distance about ¼ to about ⅛ from the base 40 of the reservoir. With these example embodiments, by extending to a proximity to the reservoir base, or by extending to the reservoir base and having at least an opening 42, the funnel or shank allows the liquid to enter through the funnel (or shank when a funnel is not used) and exit at the bottom proximate the reservoir base, thereby gliding along the funnel conduit (or the shank conduit if a separate funnel is not used) which minimizes foaming. Applicant has discovered that an inner diameter 59 of the funnel conduit, (or the shank conduit when a funnel is not used) that extends to a location that is proximate the base of the reservoir or to the base of the reservoir, in the range about 1/16 to about 3 inches, preferably in the range of up to 1 and ⅛ inch and more preferably in the range of ¼ to ⅝ inch results in sufficient or significant reduction of foaming. In an example embodiment, the inner diameter 59 is about ⅜ inch. In the example embodiment shown in FIG. 1, to fill the reservoir, the spout and pump are removed and the liquid soap is placed within the funnel portion 20, so that it glides along the funnel conduit inner surface to the bottom of the reservoir.

In the example embodiment shown in FIGS. 1 and 2, the pump causes the fluid to travel up the funnel conduit through a feed tube 41 (shown partially in FIG. 2) extending through the funnel in the reservoir and to the spout. In example embodiment where the shank conduit portion extends to proximate the base or to the base, the fluid will travel through the feed tube 41 extending through the shank conduit portion when being pumped. If the conduit extends to the base of the reservoir, the feed tube 41 may extend through one of the at least one opening 41 on the funnel conduit or shank conduit.

In an example embodiment, the funnel portion 20 when a funnel is used, or an upper portion 30 of the shank when a funnel is not used, has a shape to further minimize foaming. Applicant has discovered that a shape including a constant diameter section 50 which tapers with a tapering section 54 to the lower diameter section 52 creates a funnel portion that minimizes foaming.

In yet a further example embodiment, where the funnel is inserted within the shank, a grommet or ring (individually or collectively "grommet") 57, and in an example embodiment, a rubber grommet is placed around the funnel conduit proximate an upper portion of the reservoir such as the neck 58 of the reservoir. With this embodiment, even though the foaming is minimized, some foaming may occur on top of the liquid within the reservoir as the reservoir is being filled. As the reservoir fills with liquid, the foam created causes the funnel to lift. As the funnel lifts, the grommet engages a reservoir wall, such as a lower surface 68 of a cap 69 top wall 61 penetrated by the funnel conduit 26, and prevents the funnel from further rising (as for example shown in FIG. 2). In an example embodiment, the grommet may be made from material that is buoyant and assist in lifting the funnel. In other example embodiments, instead of a grommet, another member or members may be mounted on the conduit. Such members may or may not be annular. If the grommet or member is a floating member, it may be made of any material capable of floating and lifting the funnel. When funnel lifts, it gives the operator, who is filling the reservoir with the liquid soap, an indication that he/she has filled it sufficiently.

Figure 4:
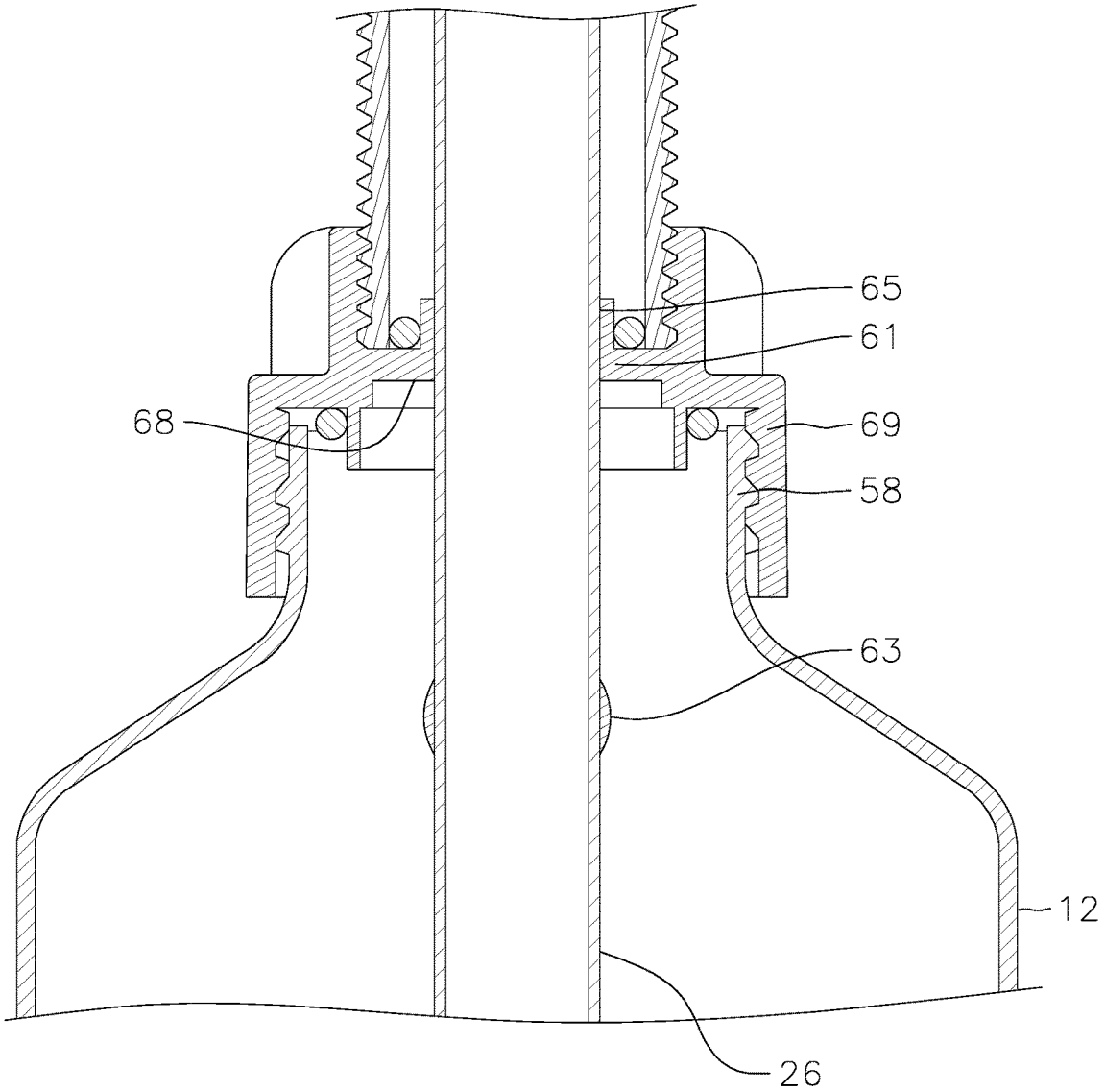
FIG. 4 is a partial cross-sectional view of another example embodiment dispenser.

In another example embodiment as shown in FIG. 4, instead of a grommet, the funnel conduit 26 may be formed with an annular protrusion 63 or with one or more protrusions 63 arranged circumferentially around the funnel conduit 26. Such protrusion(s) would engage a reservoir wall, such as the lower surface 68 of the reservoir cap top wall 61 penetrated by the funnel conduit 26 to prevent the funnel from further rising as the reservoir is being filled with liquid. The protrusion and/or the conduit may be made from a material that may be flexible such that the conduit may be pushed through an opening 65 formed on the cap adjacent to which is formed the cap wall 61, as for example shown in FIG. 4. In other example embodiments, the conduit itself flexes, as such the protrusions may or may not be themselves flexible. In other words, as the conduit is pushed through the opening 65 on the cap, when inserting the conduit into the reservoir, the protrusion and/or conduit compresses allowing the protrusion to squeeze through the opening and then expand when moved past the opening. Once expanded, the protrusion will engage the lower surface 68 cap top wall 61, as it is being lifted. In other words, the protrusion radially overlaps with the cap top wall. In an example embodiment, when a sufficient pulling force is applied to the conduit, the protrusion and/or conduit compress as they try to withdraw from the opening 65 to allow the conduit to withdraw through the opening 65 formed on the cap top wall. This sufficient force is greater than the force provided to the conduit by the rising liquid or foam in the reservoir.

When the funnel lifts it also allows venting of air/gases from the reservoir through an annular space 60 between the funnel conduit 26 and the shank conduit 32. In other words the air that is being displaced as the reservoir is filled is allowed to vent through the annular space 60 between the funnel conduit and the shank conduit (FIG. 1). If the air is not allowed to vent, then the air will not be able to be displaced by the liquid in the reservoir. As such, the reservoir would not be able to be filled adequately or completely, as air in the reservoir would occupy a volume of the reservoir preventing that volume to be filled with the liquid. In another example embodiment a vent opening 62 is formed through the funnel conduit 26 wall at a location proximate an upper portion of the reservoir. In this regard, air/gas in the reservoir will vent through the vent opening into the funnel conduit and vent out of the funnel portion 20. While the vent opening can be formed at any location on the funnel it is preferred that it is formed on the funnel conduit at an upper portion of the reservoir and preferably at a level of the neck 58 of the reservoir. In this regard the liquid soap will not obstruct the vent opening until the reservoir is filled. In addition any liquid venting through the vent opening will vent back into the reservoir.

Figure 5:
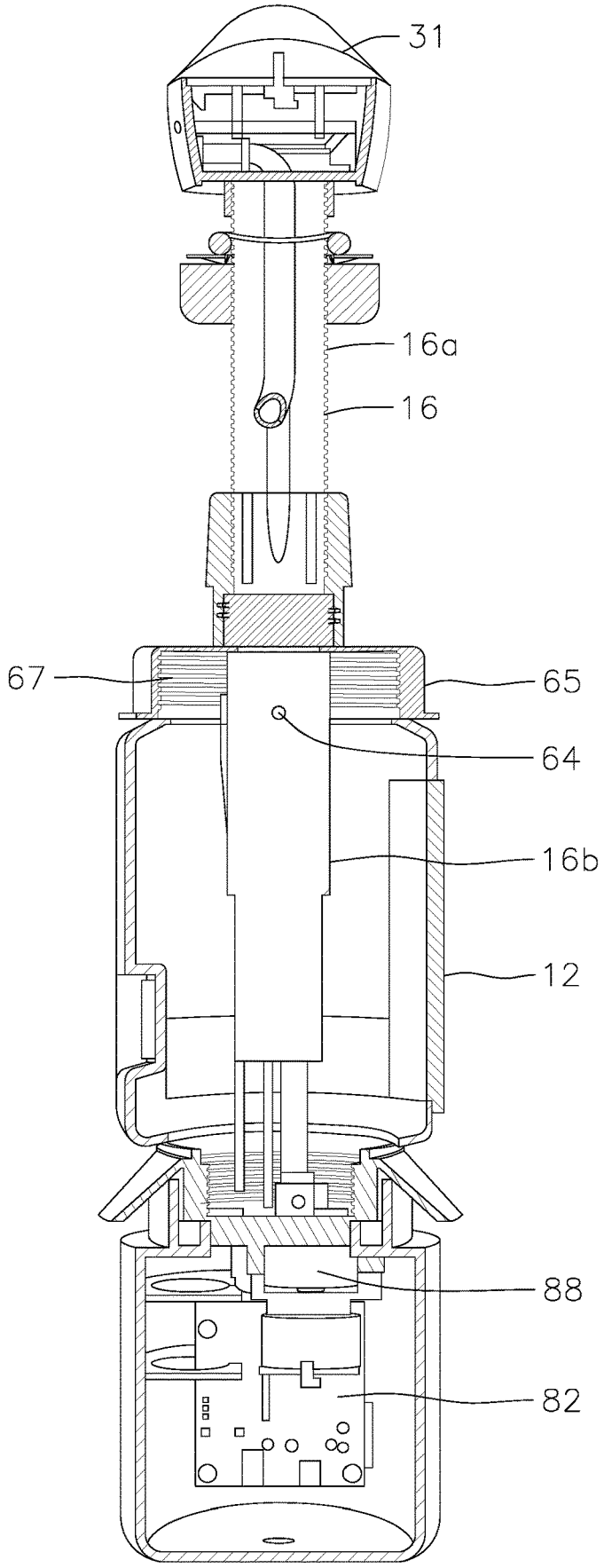
FIG. 5 is cross-sectional view of an example embodiment power operated dispenser.

In the example embodiment shown in FIG. 5, only a shank 16, which is a two-piece shank having an upper portion 16*a* connected to a lower portion 16*b* is used, defining a shank conduit 26 with this embodiment, a separate funnel is not necessary. With this embodiment a vent opening 64 is formed through the shank conduit proximate the upper end of the reservoir to allow air to escape as the reservoir is filled with liquid. The vent opening 64 is formed through both portions 16*a*, 16*b*. In the embodiment shown in FIG. 5, an electric pump 88 is used and the reservoir when capped is completely sealed, except that air in the reservoir escapes through the vent opening and escapes up through the shank and out of the shank. By placing the vent opening 64 proximate the upper end of the reservoir, the reservoir can be filled with liquid without such liquid blocking the vent opening.

In the shown example embodiment, the shank lower portion 16*b* is integrally formed with a reservoir cap 65. In an example embodiment, when fitted into the shank lower portion 16*b*, the shank upper portion occupies a sufficient length of the lower portion so that it is stable relative to the lower portion. In an example embodiment, the upper portion when inserted into the lower portion, occupies at least half of the length of the lower portion. With any of the aforementioned example embodiments, the vent may be formed at a level of a neck 58 of the reservoir.

Figure 6:
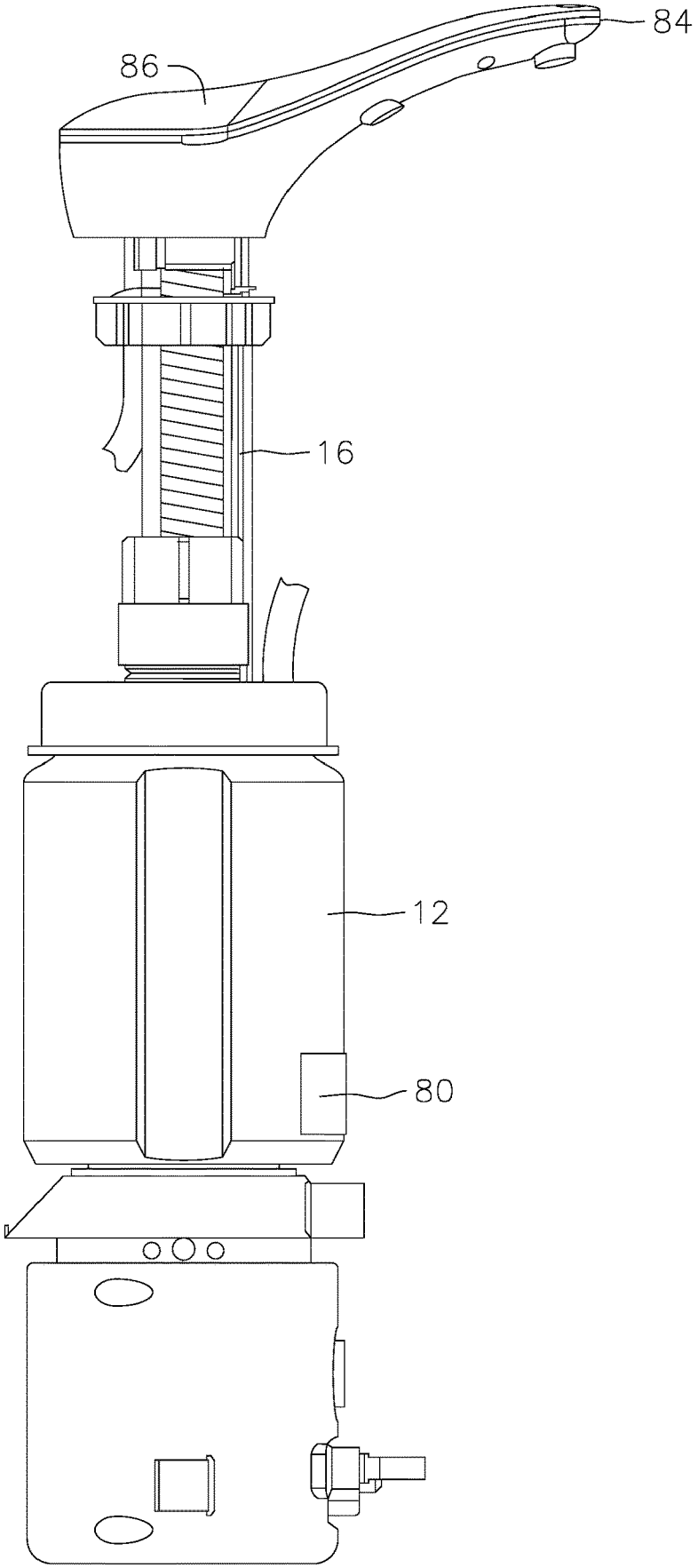
FIG. 6 is a side view of the example embodiment power operated dispenser shown in FIG. 5.

In another example embodiment, a sensor, such as an IR sensor 80, is placed on the reservoir and may be placed external of the reservoir, as for example shown in FIG. 6. In an example embodiment, the sensor is placed proximate the base of the reservoir. The sensor senses the level of fluid in the reservoir. When the level of fluid reaches a level below a pre-determined level, the sensor sends a signal to a processor, such as the processor 82 shown in FIG. 5, which sends a signal to an indicator, such as a light 84 at the tip of the spout 86 (or at other locations). In response, the indicator, which in another example embodiment, may be at another location, on or off the spout, (preferably visible to someone entering the bathroom) lights or flashes a light, such as an orange light, indicating that the reservoir is almost empty. This light indicates that the reservoir needs to be refilled (e.g., it is almost empty). The sensor continuously monitors the level of the liquid to determine if it is below the predetermined level. The sensor checks at least once every time liquid or foam is dispensed. A counter monitored by the processor counts the number of dispenses after the sensor has sensed that the level of the liquid is below the predetermined level. If after a predetermined number of dispenses, the level of the liquid is still below the predetermined level, another signal is sent by the processor to the indicator causing the indicator to emit a different color light, such as a red light or another color light, or flashes such color light. This indicates that the reservoir is almost empty and a signal is sent by the processor to prevent the dispenser from dispensing any more foam or liquid soap. This can be accomplished by stopping power from being delivered to the pump. In this regard, the chance of the pump operating when not submerged in liquid is eliminated. This prevents dry operation of the pump (i.e., operation of the pump when not submerged in liquid) which may lead to premature failure of the pump. If at any time the sensor senses that the liquid level is at or above the predetermined level, the indicator lights are turned off and normal dispensing is allowed. Other colors besides orange and red may be used as indicators. Also, each color light may be a separate indicator.

Figure 7:
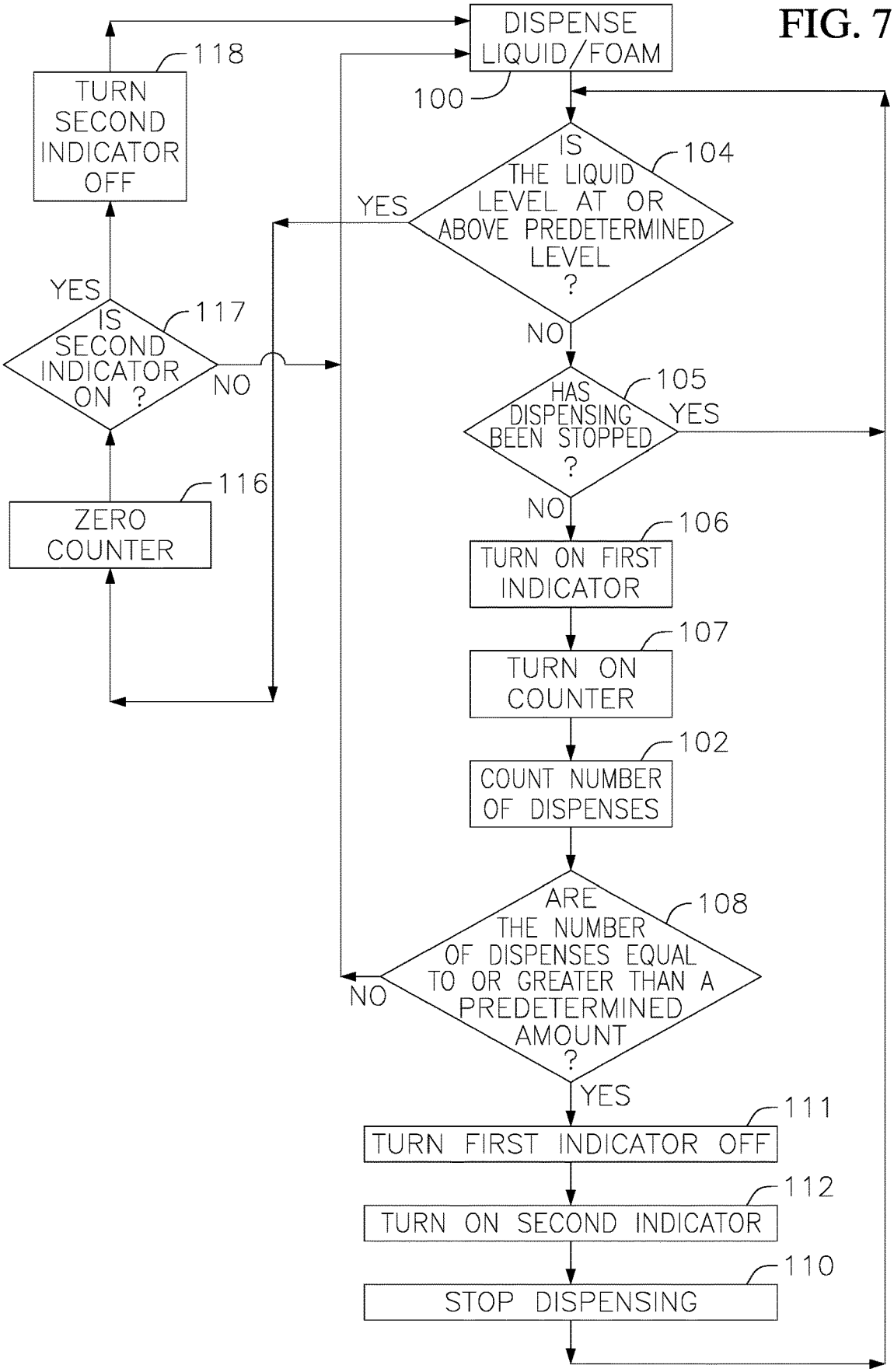
FIG. 7 is a flow chart of an example embodiment dispensing operation.

An example dispensing operation is shown in FIG. 7. Liquid soap or foam is dispensed (item 100) and if the level of the liquid soap or foam is not at or above a predetermined level (item 104), and if the dispensing has not been stopped (item 105), a first indicator is turned on, e.g., a flashing orange light (item 106), and a counter is turned on (item 107) counting the number of dispenses (item 102). It is then determined if the number of dispenses since the first indicator was turned on are equal to or greater than a predetermined amount (item 108). If they are, the first indicator is turned off (item 111) and a second indicator, e.g., a red flashing light, is turned on (item 112) and the dispensing is stopped (item 110). The first and second indicators may be the same device, e.g., the same light fixture. It is then again determined if the liquid level is at or above the predetermined level (item 104). If it is not and the dispensing has been stopped (item 114), the dispensing remains stopped and the second indicator remains on. If the liquid (soap or foam) level is at or above the predetermined level (item 104), the counter is zeroed out (item 116) and if the second indicator was turned on (item 117) it is turned off (item 118) and dispensing continues (item 100). If the second indicator was not turned on, dispensing continues.

As can be seen, the exemplary embodiment dispensers using example embodiment conduits can be any type of liquid dispenser such as liquid soap foam dispenser which are manually operated, as for example shown in FIG. 1 or power and/or automatically operated as for example shown in FIG. 5. For example the dispenser shown in FIG. 5 may include a sensor to sense when a user's hand is proximate the spout 33 so as to provide a signal which allows the pump and dispense the liquid soap (or foam).

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A method of filling a fluid dispenser comprising:

removing a top portion of the dispenser exposing a pathway to a reservoir of the fluid dispenser;

filling the reservoir with a fluid through a conduit while guiding the fluid within and along said conduit extending along a major portion of the length of the reservoir, and exiting the fluid from the conduit within a distance of 3 inches from a base of the reservoir; and venting through the conduit air displaced by filling said reservoir with said fluid through said conduit.

2. The method as recited in claim 1, wherein exiting the fluid comprises exiting the fluid from the conduit within a distance of ⅛ to 2 inches from the base of the reservoir.

3. The method as recited in claim 1, wherein exiting the fluid comprises exiting the fluid from the conduit within a distance of ¼ to ⅝ inch from the base of the reservoir.

4. The method as recited in claim 1, wherein exiting the fluid comprises exiting the fluid from the conduit within a distance of ⅛ to ¼ inch from the base of the reservoir.

5. The method as recited in claim 1, wherein exiting the fluid comprises exiting the fluid from the conduit within a distance of ⅛ to ⅝ inch from the base of the reservoir.

6. The method as recited in claim 1, wherein venting the air comprises venting the air through the conduit at a location at or proximate an upper end of the reservoir.

7. The method as recited in claim 1, further comprising raising the conduit relative to the reservoir when the reservoir has been filled with said fluid.

8. The method as recited in claim 7, further comprising stopping the raising of the conduit when the reservoir has been filled with a predetermined amount of fluid.

9. The method as recited in claim 7, wherein said raising is caused at least in part by a buoyancy of said conduit.

10. A method of filling a fluid dispenser comprising:

comprising removing a top portion of the fluid dispenser exposing a pathway to a reservoir of the fluid dispenser;

filling the reservoir with a fluid and guiding the fluid along a conduit extending along a major portion of the length of the reservoir; and raising of the conduit relative to the reservoir when the reservoir has been filled with said fluid.

11. The method as recited in claim 10, further comprising stopping the raising of the conduit when the reservoir has been filled with a predetermined amount of fluid.

12. The method as recited in claim 10, wherein said raising is caused at least in part by a buoyancy of said conduit.

13. A method of filling a fluid dispenser comprising:

comprising removing a top portion of the fluid dispenser exposing a pathway to a reservoir of the fluid dispenser;

filling the reservoir with a fluid and guiding the fluid within and along a conduit extending along a major portion of the length of the reservoir and exiting the fluid from the conduit within a distance of 3 inches from a base of the reservoir; and raising the conduit relative to the reservoir when the reservoir has been filled with said fluid.

14. The method as recited in claim 13, wherein exiting the fluid comprises exiting the fluid from the conduit within a distance of ⅛ to 2 inches from the base of the reservoir.

15. The method as recited in claim 13, wherein exiting the fluid comprises exiting the fluid from the conduit within a distance of ¼ to ⅝ inch from the base of the reservoir.

16. The method as recited in claim 13, wherein exiting the fluid comprises exiting the fluid from the conduit within a distance of ⅛ to ¼ inch from the base of the reservoir.

17. The method as recited in claim 13, wherein exiting the fluid comprises exiting the fluid from the conduit within a distance of ⅛ to ⅝ inch from the base of the reservoir.

18. The method as recited in claim 13, further comprising venting the air through the conduit at a location at or proximate an upper end of the reservoir.

19. The method as recited in claim 13, further comprising stopping the raising of the conduit when the reservoir has been filled with a predetermined amount of fluid.

20. The method as recited in claim 13, wherein said raising is caused at least in part by a buoyancy of said conduit.

* * * * *